US008596071B2

(12) United States Patent
Mueller et al.

(10) Patent No.: US 8,596,071 B2
(45) Date of Patent: Dec. 3, 2013

(54) METHOD AND APPARATUS FOR ASSEMBLING A GAS TURBINE ENGINE

(75) Inventors: Mark Anthony Mueller, West Chester, OH (US); Zhongtao Dai, Cincinnati, OH (US); Michael Louis Vermeersch, Hamilton, OH (US); Venkatraman Ananthakrishnanlyer, Mason, OH (US); Timothy James Held, Blanchester, OH (US); Jun Xu, Mason, OH (US); Keith Robert McManus, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 1771 days.

(21) Appl. No.: 11/418,613

(22) Filed: May 5, 2006

(65) Prior Publication Data

US 2007/0256418 A1 Nov. 8, 2007

(51) Int. Cl.
*F02C 3/14* (2006.01)

(52) U.S. Cl.
USPC ..... 60/756; 60/752

(58) Field of Classification Search
USPC ..... 60/737, 740, 748, 738, 749–760
See application file for complete search history.

(56) References Cited

U.S. PATENT DOCUMENTS 4,085,581 A 4/1978 Caruel et al.
4,183,539 A 1/1980 French
5,012,645 A 5/1991 Reynolds
5,253,471 A 10/1993 Richardson
5,323,604 A 6/1994 Ekstedt et al.
5,396,759 A 3/1995 Richardson
5,490,389 A 2/1996 Harrison et al.
5,657,633 A 8/1997 Brueggert
5,682,747 A 11/1997 Brown et al.
5,974,805 A 11/1999 Allen
5,996,335 A * 12/1999 Ebel ..... 60/800
6,536,216 B2 3/2003 Halila
6,540,162 B1 4/2003 Johnson et al.
6,546,733 B2 * 4/2003 North et al. ..... 60/772
6,604,286 B2 8/2003 Halila et al.
6,736,338 B2 5/2004 Johnson et al.
6,758,045 B2 7/2004 Dimov et al.
6,848,260 B2 2/2005 North et al.
6,871,501 B2 3/2005 Bibler et al.
6,952,927 B2 * 10/2005 Howell et al. ..... 60/798
6,968,693 B2 11/2005 Colibaba-Evulet et al.
2002/0088234 A1 * 7/2002 Brundish et al. ..... 60/740
2004/0237532 A1 * 12/2004 Howell et al. ..... 60/748

* cited by examiner

*Primary Examiner* — Andrew Nguyen
(74) *Attorney, Agent, or Firm* — Matthew P. Hayden, Esq.; Armstrong Teasdale LLP

(57) ABSTRACT

A method for assembling a gas turbine engine combustor is provided. The method includes providing a heat shield defined by a perimeter. The perimeter includes a radially inner edge, a radially outer edge, an axially inner edge, an axially outer edge, and an opening that extends from an upstream side of the heat shield to a downstream side of the heat shield. The method further includes coupling the heat shield to a domeplate such that the perimeter of the heat shield is positioned a distance downstream from an edge of the heat shield defining the opening. The method additionally includes coupling at least one fuel injector to the domeplate such that a portion of the fuel injector extends through the heat shield opening.

19 Claims, 4 Drawing Sheets

METHOD AND APPARATUS FOR ASSEMBLING A GAS TURBINE ENGINE

BACKGROUND OF THE INVENTION

This application relates generally to combustors and, more particularly, to a heat shield utilized within a gas turbine engine.

Air pollution concerns worldwide have led to stricter emissions standards both domestically and internationally. Pollutant emissions from industrial aero engines are subject to Environmental Protection Agency (EPA) standards that regulate the emission of oxides of nitrogen (NOx), unburned hydrocarbons (HC), and carbon monoxide (CO). In general, engine emissions fall into two classes: those formed because of high flame temperatures (NOx), and those formed because of low flame temperatures that do not allow the fuel-air reaction to proceed to completion (HC & CO).

At least some known gas turbine combustors include a plurality of mixers which mix high velocity air with liquid fuels, such as diesel fuel, or gaseous fuels, such as natural gas, to enhance flame stabilization and mixing. At least some known mixers include a single fuel injector located at a center of a swirler for swirling the incoming air. Both the fuel injector and mixer are located on a combustor dome. The combustor includes a mixer assembly and a heat shield that facilitates protecting the dome assembly. The heat shields are cooled by air impinging on the dome to facilitate maintaining operating temperature of the heat shields within predetermined limits.

During operation, the expansion of the mixture flow discharged from a pilot mixer may generate toroidal vortices around the heat shield. Unburned fuel may be convected into these unsteady vortices. After mixing with combustion gases, the fuel-air mixture ignites, and an ensuing heat release can be very sudden. In many known combustors, hot gases surrounding heat shields facilitate stabilizing flames created from the ignition. However, the pressure impulse created by the rapid heat release can influence the formation of subsequent vortices. Subsequent vortices can lead to pressure oscillations within combustor that exceed acceptable limits.

BRIEF DESCRIPTION OF THE INVENTION

In one aspect, a method for assembling a gas turbine engine combustor is provided. The method includes providing a heat shield defined by a perimeter. The perimeter includes a radially inner edge, a radially outer edge, an axially inner edge, an axially outer edge, and an opening that extends from an upstream side of the heat shield to a downstream side of the heat shield. The method further includes coupling the heat shield to a domeplate such that the perimeter of the heat shield is positioned a distance downstream from an edge of the heat shield defining the opening. The method additionally includes coupling at least one fuel injector to the domeplate such that a portion of the fuel injector extends through the heat shield opening.

In a further aspect, a heat shield for a gas turbine engine combustor is provided. The heat shield is configured to couple against a domeplate. The heat shield includes a perimeter including a radially inner edge, a radially outer edge, an axially outer edge, and an axially inner edge. The heat shield also includes an opening. The heat shield is non-planar and extends arcuately from the opening to the perimeter. The perimeter is downstream from the opening when the heat shield is coupled to the domeplate.

In an additional aspect, a gas turbine engine combustor is provided. The gas turbine engine combustor includes a pilot mixer, a main mixer extending circumferentially around the pilot mixer, and an annular centerbody extending between the pilot mixer and the main mixer. The annular centerbody includes a radially inner surface and a radially outer surface. Each of the radially inner and radially outer surfaces extend arcuately from a leading edge downstream to a trailing edge to facilitate reducing vortex formation downstream from the centerbody.

DETAILED DESCRIPTION OF THE INVENTION

Figure 1:
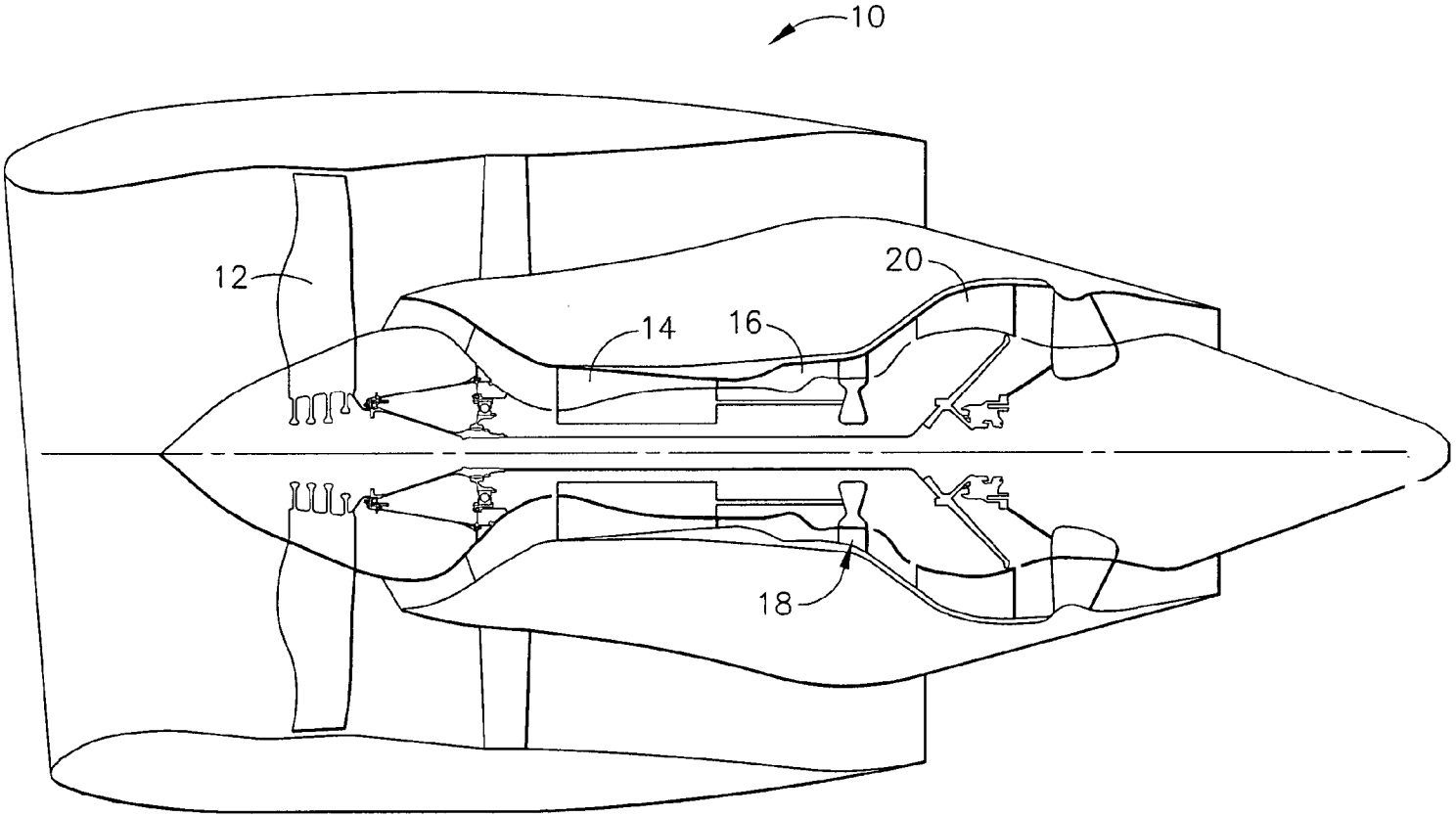
FIG. 1 is schematic illustration of a gas turbine engine including a combustor.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20.

In operation, air flows through low pressure compressor 12 and compressed air is supplied from low pressure compressor 12 to high pressure compressor 14. The highly compressed air is delivered to combustor 16. Airflow (not shown in FIG. 1) from combustor 16 drives turbines 18 and 20. In one embodiment, gas turbine engine 10 is a CFM engine. In another embodiment, gas turbine engine 10 is an LMS100 DLE engine available from General Electric Company, Cincinnati, Ohio.

Figure 2:
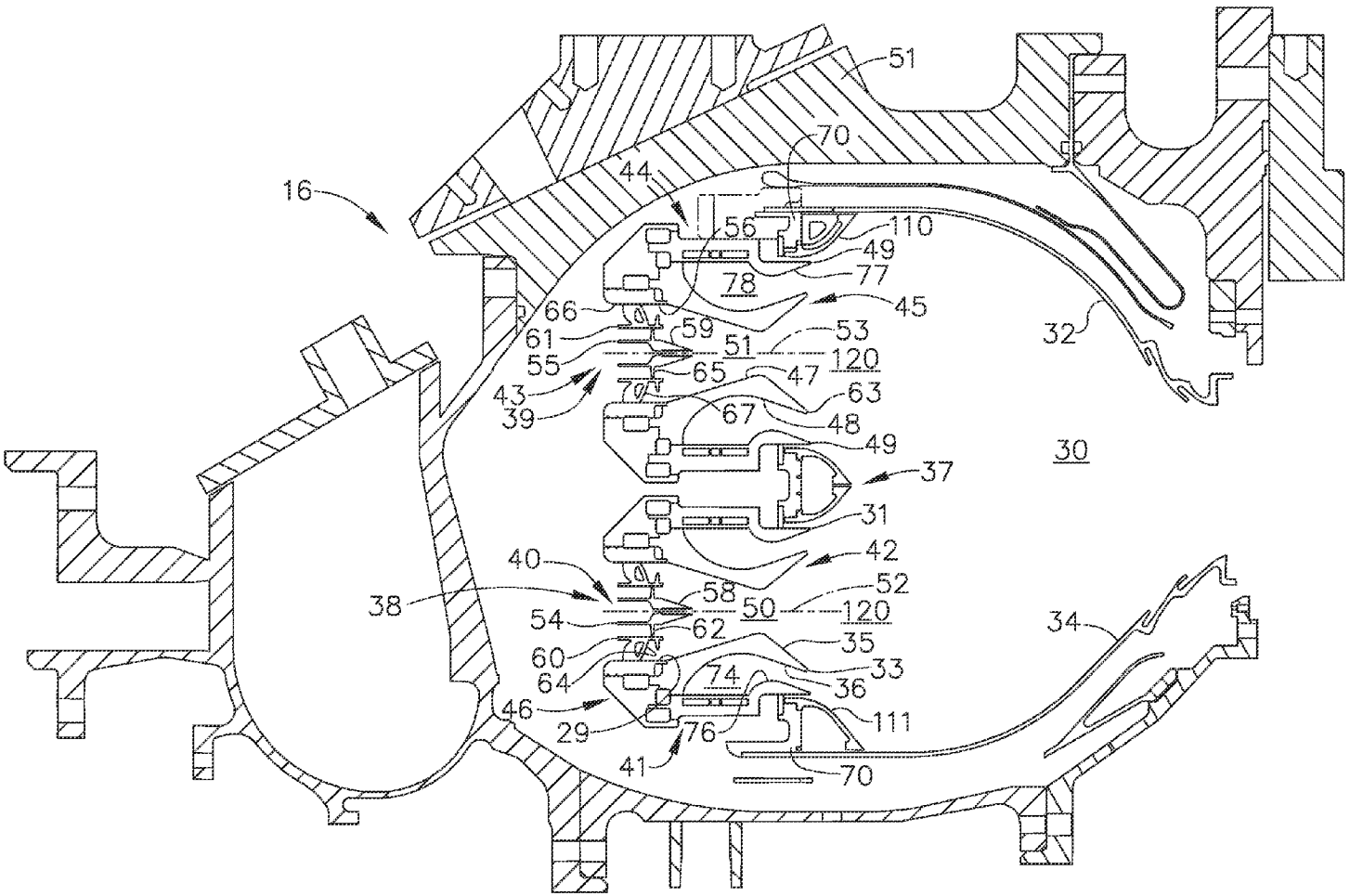
FIG. 2 is a cross-sectional view of an exemplary combustor that may be used with the gas turbine engine shown in FIG. 1.

FIG. 2 is a cross-sectional view of exemplary combustor 16, shown in FIG. 1. Combustor 16 includes a combustion zone or chamber 30 defined by annular, radially outer and radially inner liners 32 and 34. More specifically, outer liner 32 defines an outer boundary of combustion chamber 30, and inner liner 34 defines an inner boundary of combustion chamber 30. Liners 32 and 34 are radially inward from an annular combustor casing 51, which extends circumferentially around liners 32 and 34.

Combustor 16 also includes a domeplate, generally indicated as domeplate 37, and includes domeplate portions 70. Domeplate 37 is mounted upstream from combustion chamber 30 such that domeplate 37 defines an upstream end of combustion chamber 30. At least two mixer assemblies 38, 39 extend from domeplate 37 to deliver a mixture of fuel and air to combustion chamber 30. Specifically, in the exemplary embodiment, combustor 16 includes a radially inner mixer assembly 38 and a radially outer mixer assembly 39. In the exemplary embodiment, combustor 16 is known as a dual annular combustor (DAC). Alternatively, combustor 16 may be a single annular combustor (SAC) or a triple annular combustor (TAC).

Generally, each mixer assembly 38, 39 includes a pilot mixer, a main mixer, and an annular centerbody extending therebetween. Specifically, in the exemplary embodiment, inner mixer assembly 38 includes a pilot mixer 40, a main mixer 41 having a trailing edge 31, and an inner annular centerbody 42 extending between main mixer 41 and pilot mixer 40. Similarly, mixer assembly 39 includes a pilot mixer 43, a main mixer 44 having a trailing edge 49, and an annular centerbody 45 extending between main mixer 44 and pilot mixer 43.

Annular centerbody 42 includes a radially outer surface 35, a radially inner surface 36, a leading edge 29, and a trailing edge 33. In the exemplary embodiment, radially outer surface 35 is convergent-divergent, and radially inner surface 36 extends arcuately to trailing edge 33. More specifically, surface 35 defines a flow path for inner pilot mixer 40, and surface 36 defines a flow path for main mixer 41. A pilot centerbody 54 is substantially centered within pilot mixer 40 with respect to an axis of symmetry 52.

Similarly, annular centerbody 45 includes a radially outer surface 47, a radially inner surface 48, a leading edge 56, and a trailing edge 63. In the exemplary embodiment, radially outer surface 47 is convergent-divergent and radially inner surface 48 extends arcuately to trailing edge 63. More specifically, surface 47 defines a flow path for outer pilot mixer 43, and surface 48 defines a flow path for main mixer 44. A pilot centerbody 55 is substantially centered within pilot mixer 43 with respect to an axis of symmetry 53.

Inner mixer 38 also includes a pair of concentrically mounted swirlers 60. More specifically, in the exemplary embodiment, swirlers 60 are axial swirlers and each includes an integrally-formed inner swirler 62 and an outer swirler 64. Alternatively, pilot inner swirler 62 and pilot outer swirler 64 may be separate components. Inner swirler 62 is annular and is circumferentially disposed around pilot centerbody 54, and outer swirler 64 is circumferentially disposed between pilot inner swirler 62 and a radially inner surface 35 of centerbody 42.

In the exemplary embodiment, pilot inner swirler 62 discharges air swirled in the same direction as air flowing through pilot outer swirler 64. In another embodiment, pilot inner swirler 62 discharges swirled air in a rotational direction that is opposite a direction that pilot outer swirler 64 discharges air.

Main mixer 41 includes an outer throat surface 76, that in combination with centerbody radially outer surface 36, defines an annular premixer cavity 74. In the exemplary embodiment, centerbody 42 extends into combustion chamber 30. Main mixer 41 is concentrically aligned with respect to pilot mixer 40 and extends circumferentially around mixer 38. In the exemplary embodiment, a radially outer surface 76 within mixer 41 is arcuately formed and defines an outer flow path for main mixer 41.

Similarly, outer mixer 39 also includes a pair of concentrically mounted swirlers 61. More specifically, in the exemplary embodiment, swirlers 61 are axial swirlers and each includes an integrally-formed inner swirler 65 and an outer swirler 67. Alternatively, pilot inner swirler 65 and pilot outer swirler 67 may be separate components. Inner swirler 65 is annular and is circumferentially disposed around pilot centerbody 55, and outer swirler 67 is circumferentially disposed between pilot inner swirler 65 and radially inner surface 47 of centerbody 45.

In the exemplary embodiment, pilot swirler 65 discharges air swirled in the same direction as air flowing through pilot swirler 67. In another embodiment, pilot inner swirler 65 discharges swirled air in a rotational direction that is opposite a direction that pilot outer swirler 67 discharges air.

Main mixer 44 includes an outer throat surface 77, that in combination with centerbody radially outer surface 48, defines an annular premixer cavity 78. In the exemplary embodiment, centerbody 45 extends into combustion chamber 30. In the exemplary embodiment, a radially outer surface 77 within mixer 43 is arcuately formed and defines an outer flow path for main mixer 43. Main mixer 44 is concentrically aligned with respect to pilot mixer 43 and extends circumferentially around mixer 39.

In the exemplary embodiment, combustor 16 also includes an outer heat shield 110 and an inner heat shield 111. In the exemplary embodiment, heat shields 110 and 111 are removably coupled downstream from domeplate 37 such that fluids discharged from premixer cavities 74 and 78 are directed downstream and radially inwardly along surfaces 114 of heat shields 110 and 111.

During assembly, heat shields 110 and 111 are coupled within combustor 16 to inner liners 32 and 34, respectively, such that mixer assembly 38 is substantially centered within inner heat shield 111, and mixer assembly 39 is substantially centered within outer heat shield 110. Heat shield 110 is positioned substantially circumferentially around at least one mixer assembly 39, and heat shield 111 is positioned substantially circumferentially around at least one mixer assembly 38. More specifically, in the exemplary embodiment, at least one mixer assembly 38 extends through opening 116 in heat shield 111, and at least one mixer assembly 39 extends through opening 116 in heat shield 110.

During operation, pilot inner swirlers 62 and 65, pilot outer swirlers 64 and 67, and main swirlers 41 and 44 are designed to effectively mix fuel and air. Pilot inner swirlers 62 and 65, pilot outer swirlers 64 and 67, and main swirlers 41 and 44 impart angular momentum to a fuel-air mixture forming recirculation zones 120 downstream from each mixer assembly 38 and 39. After the fuel-air mixture flows from each mixer assembly 38 and 39, the mixture ignites and forms a flame front that is stabilized by recirculation zones 120. The local gas velocity at recirculation zones 120 is approximately equal to the turbulent flame speed. Heat shields 110 and 111 extend into combustion chamber 30 such that the unburned fuel-air mixture is adjacent heat shields 110 and 111. As such, the gas temperature adjacent heat shields 110 and 111 are approximately equal to the compressor discharge temperature rather than the adiabatic flame temperature. Moreover, because heat shields 110 and 111 extend arcuately into combustion chamber 30, heat shields 110 and 111 facilitate reducing a portion of the combustor volume that would normally be filled with a recirculating mixture of unburned reactants and hot products of combustion.

Figure 3:
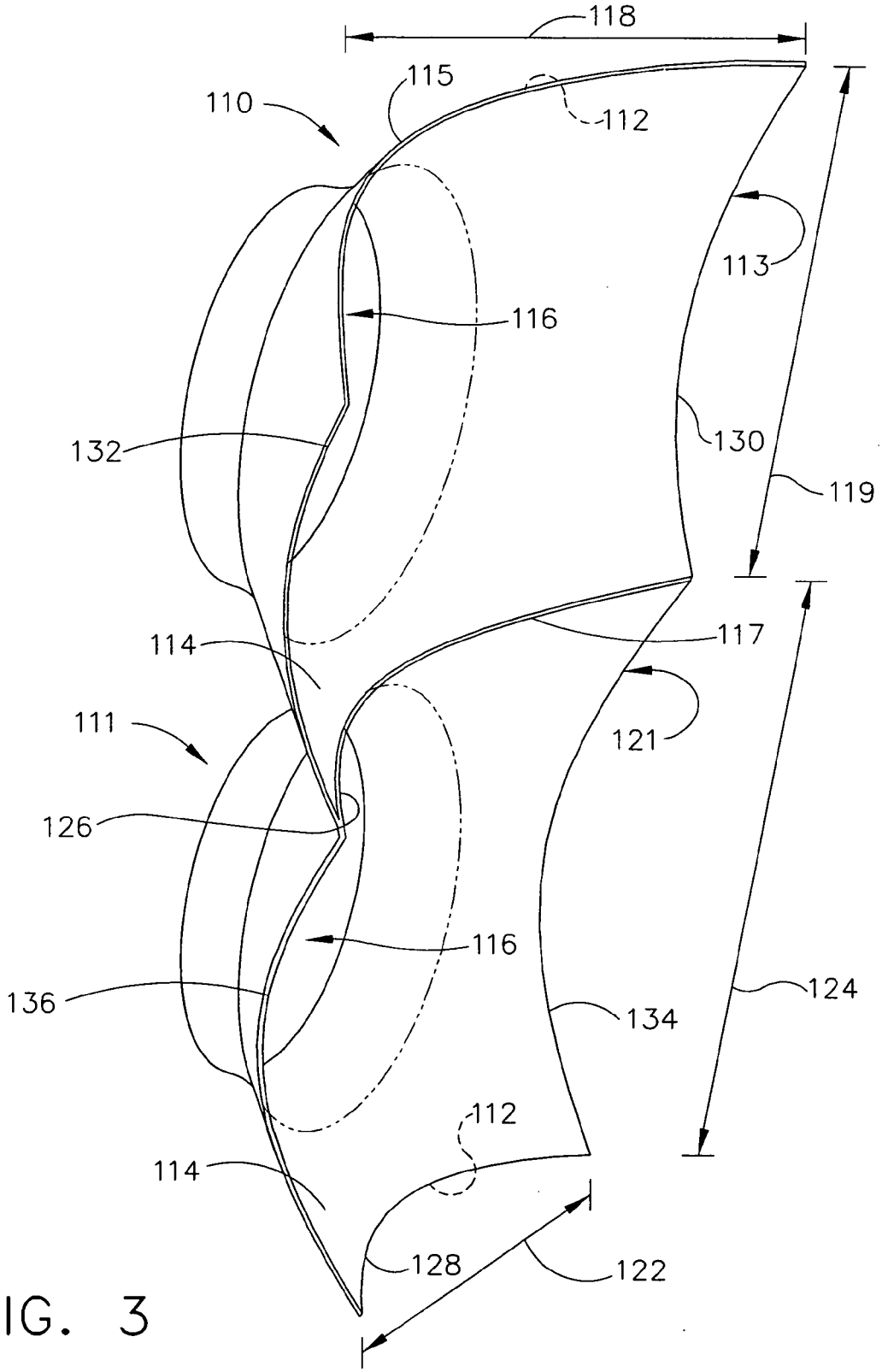
FIG. 3 is a perspective view of exemplary heat shields used with the combustor shown in FIG. 2.

FIG. 3 is a perspective view of heat shields 110 and 111. A portion of inner and outer heat shields 110 and 111 extend into combustor chamber 30. Heat shields 110 and 111 are separate discrete shield members. In the exemplary embodiment, heat shield 110 includes an upstream side 112, a downstream side 114, a perimeter 113, and an opening 116. Perimeter 113 of heat shield 110 is defined by a radially outer edge 115, a radially inner edge 117, an axially outer edge 130, and an axially inner edge 132. Similarly, heat shield 111 includes an upstream side 112, a downstream side 114, a perimeter 121, and an opening 116. Perimeter 121 of heat shield 111 is defined by a radially outer edge 126, a radially inner edge 128, an axially outer edge 134, and an axially inner edge 136. Upstream sides 112 and downstream sides 114 are each non-planar and each is formed arcuately. More specifically, in the exemplary embodiment, upstream sides 112 and downstream sides 114 are each formed arcuately with a substantially semi-spherical shape that is based on a conical surface of revolution. Alternatively, upstream sides 112 and downstream sides 114 are each formed arcuately with a shape that is not based on a conical surface of revolution. Specifically, heat shield 110 extends arcuately from opening 116 to perimeter 113 such that perimeter 113 is downstream from opening 116 when heat shield 110 is coupled within combustor 16. Similarly, heat shield 111 extends arcuately from opening 116 to perimeter 121 such that perimeter 121 is downstream from opening 116 when heat shield 111 is coupled within combustor 16. The arcuate shape of heat shields 110 and 111 facilitate ensuring that recirculation zones 120 do not extend to heat shield surfaces 114. Therefore, in this embodiment, only unburned gas-air mixtures are in contact with heat shield surfaces 114.

Furthermore, heat shield 110 has an axial width 118, a radial height 119, and a thickness (not shown). Heat shield 111 has an axial width 122, a radial height 124, and a thickness (not shown). In the exemplary embodiment, axial width 118 is wider than axial width 122, and radial height 119 is longer than radial height 124. Alternatively, axial width 118 is equal or less than the distance of axial width 122. Similarly, in an alternative embodiment, radial height 119 is equal or less than the distance of radial height 124.

Additionally, in the exemplary embodiment, heat shield 110 tapers inwardly such that radially outer edge 115 is longer than radially inner edge 117. Alternatively, radially outer edge 115 and radially inner edge 117 are equal in length. In a further alternative embodiment, radially outer edge 115 is shorter than radially inner edge 117. Similarly, heat shield 111 tapers inwardly such that radially outer edge 126 is longer than radially inner edge 128. Alternatively, radially outer edge 126 and radially inner edge 128 are equal in length. In a further alternative embodiment, radially outer edge 126 is shorter than radially inner edge 128.

Figure 4:
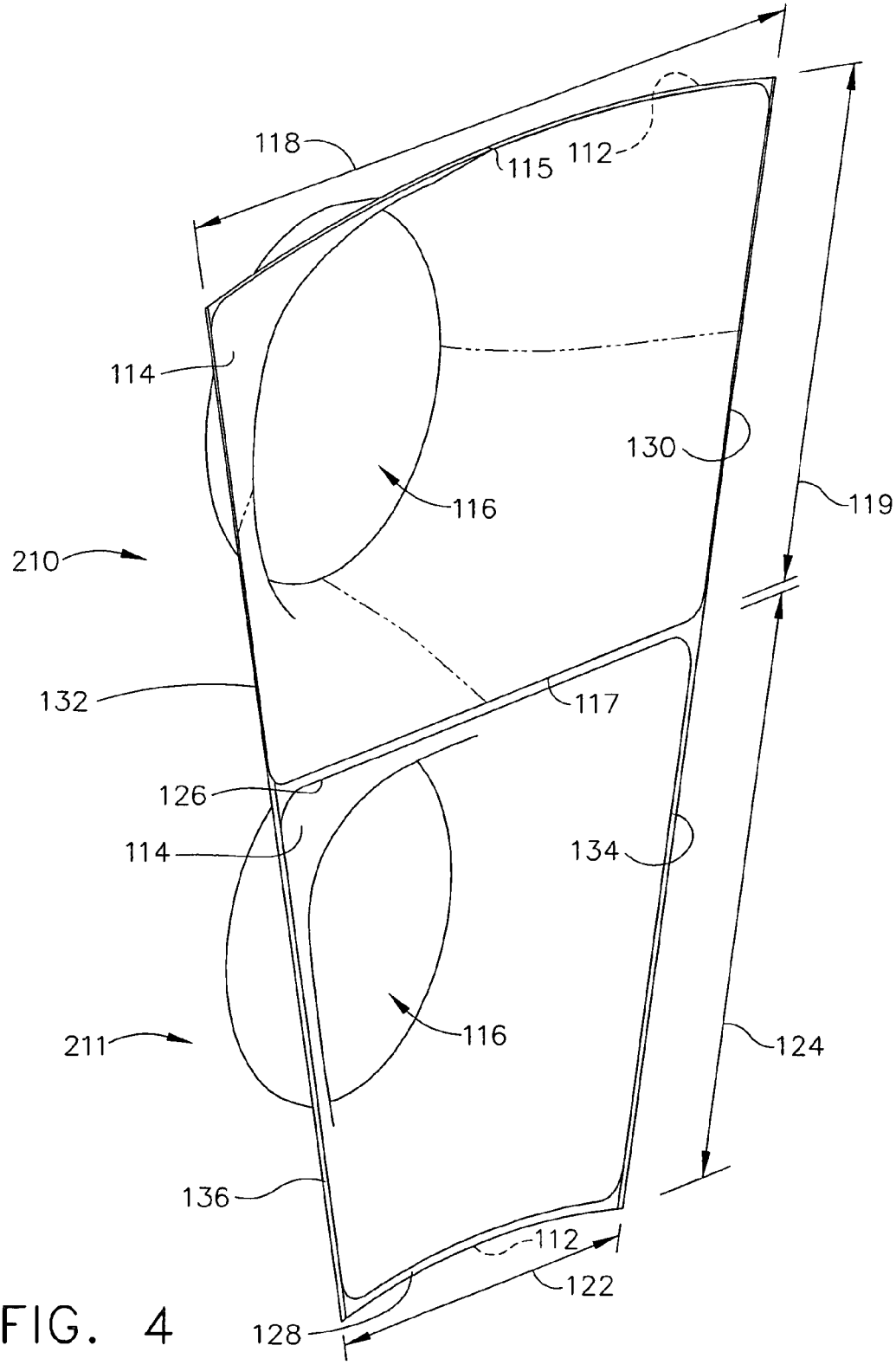
FIG. 4 is a perspective view of alternative embodiments of heat shields that may be used with the combustor shown in FIG. 2.

FIG. 4 is a perspective view of an alternative embodiment of an outer heat shield 210 and an inner heat shield 211 that may be used with combustor 16 (shown in FIG. 2). Similarly, heat shields 210 and 211 are formed arcuately with a shape that is not based on a conical surface of revolution. More specifically, in this alternative embodiment, heat shields 210 and 211 are substantially semi-elliptical shape. Such a semi-elliptical shape of heat shields 210 and 211 facilitate enhanced sealing to domeplate 37 along radially outer edges 115 and 117, respectively. Additionally, the flow fields of heat shields 110 and 111 are slightly different than flow fields of heat shields 210 and 211 based on their respective arcuate shapes.

With respect to inner mixer assembly 38, the arcuate shape of surfaces 35, 36, and 76 facilitate producing a desired velocity profile at the exit of inner mixer assembly 38. In particular, surfaces 35, 36, and 76 facilitate channeling the flow with a radially outward velocity to facilitate a seamless transition towards heat shield 111 downstream side 114. Similarly, with respect to outer mixer assembly 39, surfaces 47, 48, and 77 facilitate generally a velocity profile at the exit of outer mixer assembly 39. A seamless transition facilitates preventing flow separation such that other recirculation zones downstream from heat shield 110, 111 are eliminated.

The flow field inside combustion chamber 30 inhibits shedding of large-scale vortices from mixer assemblies 38 and 39. In the absence of flame-vortex interactions, heat release due to combustion is steadier and less prone to amplify pressure oscillations inherent in turbulent combustion. This behavior facilitates reduced acoustic magnitudes, improved operability, and increased durability of combustor components.

In typical operation, metal temperatures routinely exceed 1600° F. This requires heat shields 110 and 111 be fabricated from materials that retain sufficient strength at high temperatures. In the exemplary embodiment, heat shields 110 and 111 used in combustor 16 are fabricated from Rene N5, a nickel-based super alloy.

The heat shield assembly described herein may be utilized on a wide variety of gas turbine engines. The above-described heat shields include arcuately formed surfaces that cooperate with arcuate surfaces defined in a main mixer and premixer assembly. As a result, operability is improved by eliminating heat release from unsteady large-scale vortices while not adversely affecting flame stability, lean blow-out, and emissions performance. The above-described heat shield and mixer assemblies improve combustor durability by reducing acoustic amplitudes and heat shield thermal stresses. Exemplary embodiments of a heat shield and mixer assemblies are described above in detail. The heat shield and mixer assemblies are not limited to the specific embodiments described herein. Specifically, the above-described heat shield is cost-effective and highly reliable, and may be utilized on a wide variety of combustors installed in a variety of gas turbine engine applications.

While the invention has been described in terms of various specific embodiments, those skilled in the art will recognize that the invention can be practiced with modification within the spirit and scope of the claims.

What is claimed is:

1. A method for assembling a gas turbine engine combustor, said method comprising:

providing a heat shield defined by a perimeter, the perimeter including a radially inner edge, an opposing radially outer edge, a first axial edge, an opposing second axial edge, and an opening that extends from an upstream surface of the heat shield to a downstream surface of the heat shield, wherein said downstream surface extends arcuately and convexly from said opening to said perimeter and said perimeter is downstream of the opening;

coupling an outer edge of the opening of the heat shield to a domeplate such that the perimeter of the heat shield is positioned a distance downstream from the outer edge of the opening, wherein the heat shield is sealingly coupled to the domeplate along at least one of the radially inner and radially outer edges of the perimeter; and coupling at least one mixer assembly to the domeplate such that a portion of the mixer assembly extends through the opening.

2. A method in accordance with claim 1 wherein the downstream surface of the heat shield is non-planar.

3. A method in accordance with claim 1 wherein the heat shield is formed arcuately with a substantially semi-spherical shape.

4. A method in accordance with claim 1 wherein the heat shield is formed arcuately with a substantially semi-elliptical shape.

5. A method in accordance with claim 1 further comprising coupling the heat shield circumferentially around at least one premixer assembly that includes at least one arcuately formed surface.

6. A method in accordance with claim 5 further comprising positioning the heat shield relative to the premixer assembly to facilitate reducing the formation of vortices downstream from the premixer assembly.

7. A heat shield for a gas turbine engine combustor, said heat shield configured to couple against a domeplate, said heat shield comprising:

a perimeter including a radially inner edge, an opposing radially outer edge, a first axial edge, and an opposing second axial edge; and an opening extending from an upstream surface of the heat shield to a downstream surface of the heat shield, wherein said downstream surface is non-planar and extends arcuately and convexly from said opening to said perimeter, said perimeter being downstream from said opening when said heat shield is coupled to the domeplate, and said perimeter being configured to be sealingly coupled to said domeplate along at least one of said radially inner and radially outer edges of the perimeter when the heat shield is installed in the gas turbine engine.

8. A heat shield in accordance with claim 7 wherein said heat shield opening is sized to receive a portion of at least one mixer assembly therethrough.

9. A heat shield in accordance with claim 7 wherein each of said upstream surface and said downstream surface extend between said radially inner and outer edges and said first and second axial edges.

10. A heat shield in accordance with claim 9 wherein said downstream surface is formed arcuately with a substantially semi-spherical shape based on a conical surface of revolution.

11. A heat shield in accordance with claim 7 wherein said downstream surface is formed arcuately with a substantially semi-elliptical shape.

12. A heat shield in accordance with claim 7 wherein said heat shield is configured to extend into a combustion chamber when coupled to the domeplate.

13. A gas turbine engine combustor comprising:

a pilot mixer;

a main mixer extending circumferentially around said pilot mixer;

an annular centerbody extending between said pilot mixer and said main mixer, wherein said annular centerbody comprises a radially inner surface and a radially outer surface, each of said radially inner and radially outer surfaces extend arcuately from a leading edge downstream to a trailing edge to facilitate reducing vortex formation downstream from said centerbody; and a heat shield, said heat shield configured to couple against a domeplate, said heat shield comprising:

a perimeter including a radially inner edge, an opposing radially outer edge, a first axial edge, and an opposing second axial edge; and an opening extending from an upstream surface of the heat shield to a downstream surface of the heat shield, wherein said downstream surface is non-planar and extends arcuately and convexly from said opening to said perimeter, said perimeter being downstream from said opening when said heat shield is coupled to the domeplate, and said perimeter being configured to be sealingly coupled to said domeplate along at least one of said radially inner and radially outer edges of the perimeter when the heat shield is installed in the gas turbine engine.

14. A gas turbine engine combustor in accordance with claim 13 wherein said radially outer surface defines an outer flow path of said main mixer.

15. A gas turbine engine combustor in accordance with claim 13 wherein said radially inner surface defines an inner flow path of said main mixer.

16. A gas turbine engine combustor in accordance with claim 13 wherein each of said upstream surface and said downstream surface extends between said radially inner and outer edges and said first and second axial edges.

17. A gas turbine engine combustor in accordance with claim 16 wherein said downstream surface is formed arcuately with a substantially semi-spherical shape based on a conical surface of revolution.

18. A gas turbine engine combustor in accordance with claim 13 wherein said heat shield is configured to cooperate with said radially inner and radially outer surfaces to facilitate reducing a heat flux to said heat shield.

19. A gas turbine engine combustor in accordance with claim 13 wherein said radially outer and radially inner surfaces are configured to cooperate with said heat shield to facilitate preventing flow separation.

* * * * *